US009828774B2

(12) United States Patent
Givens

(10) Patent No.: US 9,828,774 B2
(45) **Date of Patent: *Nov. 28, 2017**

(54) ROOF DRIP EDGE

(71) Applicant: Robert D. Givens, Tellico Plains, TN (US)

(72) Inventor: Robert D. Givens, Tellico Plains, TN (US)

(73) Assignee: DryFlekt, Inc., Grantham, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/443,776

(22) Filed: Feb. 27, 2017

(65) Prior Publication Data

US 2017/0226741 A1 Aug. 10, 2017

Related U.S. Application Data

(63) Continuation-in-part of application No. 15/019,492, filed on Feb. 9, 2016, now Pat. No. 9,611,649.

(51) Int. Cl.
*E04D 13/04* (2006.01)
*E04D 13/158* (2006.01)

(52) U.S. Cl.
CPC ..... *E04D 13/0459* (2013.01); *E04D 13/158* (2013.01); *E04D 2013/0468* (2013.01)

(58) Field of Classification Search
CPC ..... E04D 13/15; E04D 13/158
See application file for complete search history.

(56) References Cited

U.S. PATENT DOCUMENTS

| | | | |
|---|---|---|---|
| 3,187,464 | A | 6/1965 | Sharp |
| 3,242,622 | A | 3/1966 | Snead |
| 3,243,926 | A | 4/1966 | Keyt |
| 3,436,877 | A | 4/1969 | Gunning |
| 4,254,594 | A | 3/1981 | Hammond et al. |
| 5,154,025 | A | 10/1992 | Brown |
| 5,328,406 | A | 7/1994 | Morris, Jr. et al. |
| 5,918,426 | A | 7/1999 | Gifford et al. |
| 6,035,587 | A | 3/2000 | Dressler |
| 8,683,695 | B2 | 4/2014 | Rasmussen et al. |
| 8,739,470 | B1 | 6/2014 | Wayne et al. |
| 2007/0074466 | A1 | 4/2007 | Rasmussen |
| 2008/0047206 | A1 | 2/2008 | Gramling |

OTHER PUBLICATIONS

Amerimax Home Products—F5 1/2 S White Aluminum Drip Edge, Advertising Literature, Retreived on Aug. 31, 2015 from http://www.homedepot.com/p/Amerimax-Home-Products-F5-1-2-S-White-Aluminum-Drip-Edge-5511600120/100074238, 2 pages.

AMICO Vinyl Roof Drip Edge—AMICO Metal Lath and Vinyl Bead Building Products > Stucco Roof Drip Edge, Retreived on Aug. 31, 2015 from http://amico-lath.com/stucco/roof_drip_edge.htm, © 2005 Alabama Metal Industries. All Rights Reserved 1 page.

Genova Products, Inc.—Genova Solid Vinyl Drip Edge, Retreived on Aug. 21, 2015 from https://www.genovaproducts.com/docs/Drip_Edge.pdf, (2001) 2 pages.

*Primary Examiner* — Patrick J Maestri
(74) *Attorney, Agent, or Firm* — St. Onge Steward Johnston & Reens, LLC

(57) ABSTRACT

A roof drip edge including a roof leg and a drip leg joined to a down leg adapted to protect the intersection of a roof and fascia of a building. Some embodiments include a back drip leg adjacent to the drip leg. Some embodiments include tabs positioned on the roof leg for protection from water infiltration under roof shingles.

20 Claims, 5 Drawing Sheets

ROOF DRIP EDGE

FIELD OF THE INVENTION

The present invention is directed to a drip edge for use on a building to direct water away from the building and into a gutter.

BACKGROUND OF THE INVENTION

Many buildings include a plurality of upstanding walls covered by a roof. The roof is typically downward sloping and covered by a plurality of shingles. The section of the wall near the roof is often covered by a fascia board for protection and also to allow installation of a gutter to collect water and other debris that rolls off of the roof.

A disadvantage of such roof constructions is that water often seeps between the gutter inner wall and the fascia board, causing rot and deterioration of the fascia board. Moreover, in some types of construction, water can seep between the fascia and the side wall of the building, causing even more extensive damage. Water can also seep in between the roof shingles and the roof boards, causing rot and deterioration of these structural elements.

In an attempt to ameliorate these problems, devices called drip edges are sometimes installed. A traditional drip edge is typically one or more sheets of metal inserted between the shingles and the roof, and that can extend out over the edge of the roof and sometimes downward in front of the fascia. In this way, the water and other debris from the roof is directed away from the building. Commonly, the water and other debris is directed into a gutter. Typically, drip edges are formed in sections that can be joined and sealed by caulk in order to cover rooflines longer than a single roof edge section.

Traditional roof drip edge designs suffer from notable drawbacks, however. First, in geographical areas in which stormy, windy weather is common, water can be forced far enough under the shingles to reach the wooden roof material. High winds, which are often accompanied by rain, can lift parts of the shingles and allow blown rain to move between the shingles and the roof. Further, wind can drive moisture up behind the downward extending portion of the drip edge such that it contacts the fascia board. This eventually causes the fascia to rot. Traditional drip edges lack sufficient size and suitable features to prevent these issues.

Next, traditional drip edges made of metal can act as lightning rods. The metal drip edges can attract lightning, which, when it occurs, can destroy the structure to which the drip edges are attached.

Furthermore, due to the nature of the metal materials typically used in traditional drip edges, they are often manufactured in sizes that require joining a number of individual drip edge components together to cover a roof edge. These joints are typically sealed with caulk, for example, silicone caulk. Caulked joint seals have a limited lifespan before they degrade and cause the seal to fail. Seal failure requires expensive repair or it can cause water leaks and, eventually, rot.

Accordingly, what is desired is a drip edge that provides improved protection of a roof and wall joint from water intrusion, particularly in geographical areas subject to intense storms. Further, what is desired is a drip edge that is resistant to degradation over time. Even further, what is desired is a drip edge that is easier and less cost intensive to manufacture, install and maintain.

SUMMARY OF THE INVENTION

It is an object of the present invention to provide a drip edge that provides improved protection a roof and wall joint from water intrusion.

It is a further object of the present invention to provide a drip edge with improved resistance to degradation over time.

It is a further object of the present invention to provide a drip edge that is easier and less cost intensive to manufacture, install, and maintain.

According to a first embodiment of the present invention, a roof drip edge device is provided that comprises: a down leg, extending substantially in a down leg plane and comprising a first side and a second side; a roof leg, extending substantially in a roof leg plane and joined to the down leg such that the roof leg extends away from the first side of the down leg; a drip leg, extending substantially in a drip leg plane and joined to the down leg such that the drip leg extends away from the second side of the down leg; and a back drip leg, extending substantially in a back drip leg plane and joined to the down leg such that the back drip leg extends away from the first side of the down leg plane. The back drip leg is joined to the down leg such that the back drip leg plane and the down leg plane are at an angle of greater than approximately 90 degrees with respect to one another.

In some embodiments, the back drip leg is joined to the down leg at substantially the same portion of the down leg as the drip leg. In some embodiments, the down leg further comprises a top edge and a bottom edge, the roof leg further comprises a top edge and a bottom edge, and the roof leg bottom edge is joined to the down leg top edge. In some embodiments, the distance between the roof leg top edge and the roof leg bottom edge is at least approximately twice the distance between the distance between the down leg top edge and the down leg bottom edge.

In some embodiments, the down leg further comprises a top edge and a bottom edge and the drip leg is joined to the down leg at the down leg bottom edge. In some embodiments, the back drip leg is joined to the down leg at the down leg bottom edge. In some embodiments, the roof leg is joined to the down leg such that the down leg plane and the roof leg plane are at approximately a 90 degree angle with respect to one another. In some embodiments, the drip leg and the back drip leg are joined to the down leg bottom edge such that the drip leg plane and the back drip leg plane are at approximately a 90 degree angle with respect to one another.

In some embodiments, the drip leg is joined to the down leg such that the drip leg plane and the down leg plane are at approximately a 135 degree angle with respect to one another. In some embodiments, the back drip leg is joined to the down leg such that the back drip leg plane and the down leg plane are at approximately a 135 degree angle with respect to one another.

In some embodiments, the device further comprises a first tab, extending from a first side of the roof leg and substantially in a first tab plane, where the first tab plane forms an angle with the roof leg plane that is less than 90 degrees and greater than 0 degrees. In some embodiments, the device further comprises a second tab, extending from the first side of the roof leg and substantially in a second tab plane, where the second tab plane is substantially parallel to the first tab plane.

In some embodiments, the device is comprised of a flexible, plastic material. In some embodiments, the device is formed by an extrusion process.

According to a second embodiment of the present invention, a roof drip edge device is provided comprising: a down leg, extending substantially in a down leg plane and comprising a first side, a second side, a top edge, and a bottom edge; a roof leg, extending substantially in a roof leg plane and comprising a top edge and a bottom edge, wherein the roof leg bottom edge is joined to the down leg top edge such that the roof leg extends away from the first side of the down leg; a drip leg, extending substantially in a drip leg plane and joined to the down leg such that the drip leg extends away from the second side of the down leg; a back drip leg, extending substantially in a back drip leg plane and joined to the down leg such that the back drip leg extends away from the first side of the down leg plane; and a tab, extending from a first side of the roof leg and substantially in a tab plane, where the tab plane forms an angle with the roof leg plane that is less than 90 degrees and greater than 0 degrees. The back drip leg is arranged with respect to the down leg such that the back drip leg will make substantially sealing contact with a roof fascia component.

In some embodiments, the back drip leg is joined to the down leg such that the back drip leg plane and the down leg plane are at an angle of greater than approximately 90 degrees with respect to one another. In some embodiments, the tab is a first tab and the tab plane is a first tab plane, and the device further comprises a second tab, extending from the first side of the roof leg and substantially in a second tab plane, where the second tab plane is substantially parallel to the first tab plane.

In some embodiments, the roof leg is joined to the down leg such that the down leg plane and the roof leg plane are at approximately a 90 degree angle with respect to one another.

According to a third embodiment of the present invention, a roof drip edge device is provided that comprises: a down leg, extending substantially in a down leg plane and comprising a first side and a second side; a roof leg, extending substantially in a roof leg plane and joined to the down leg such that the roof leg extends away from the first side of the down leg; a drip leg, extending substantially in a drip leg plane and joined to the down leg such that the drip leg extends away from the second side of the down leg; a back drip leg, extending substantially in a back drip leg plane and joined to the down leg such that the back drip leg extends away from the first side of the down leg plane; a first tab, extending from a first side of the roof leg and substantially in a first tab plane, and a second tab, extending from the first side of the roof leg and substantially in a second tab plane; and where the first tab plane forms an angle with the roof leg plane that is less than 90 degrees and greater than 0 degrees. The back drip leg is joined to the down leg such that the back drip leg plane and the down leg plane are at an angle of greater than approximately 90 degrees with respect to one another.

In some embodiments, the down leg further comprises a top edge and a bottom edge and the roof leg further comprises a top edge and a bottom edge, and the roof leg bottom edge is joined to the down leg top edge. In some embodiments, the device is comprised of a flexible, plastic material.

Exemplary embodiment(s) of the invention will now be described in greater detail in connection with the following drawings.

DETAILED DESCRIPTION OF THE INVENTION

The figures show certain embodiments of the present invention having a variety of features. It will be understood by those of skill in the art that not all of the features of each embodiment depicted or described are necessarily present in all other possible embodiments of the invention.

Figure 1:
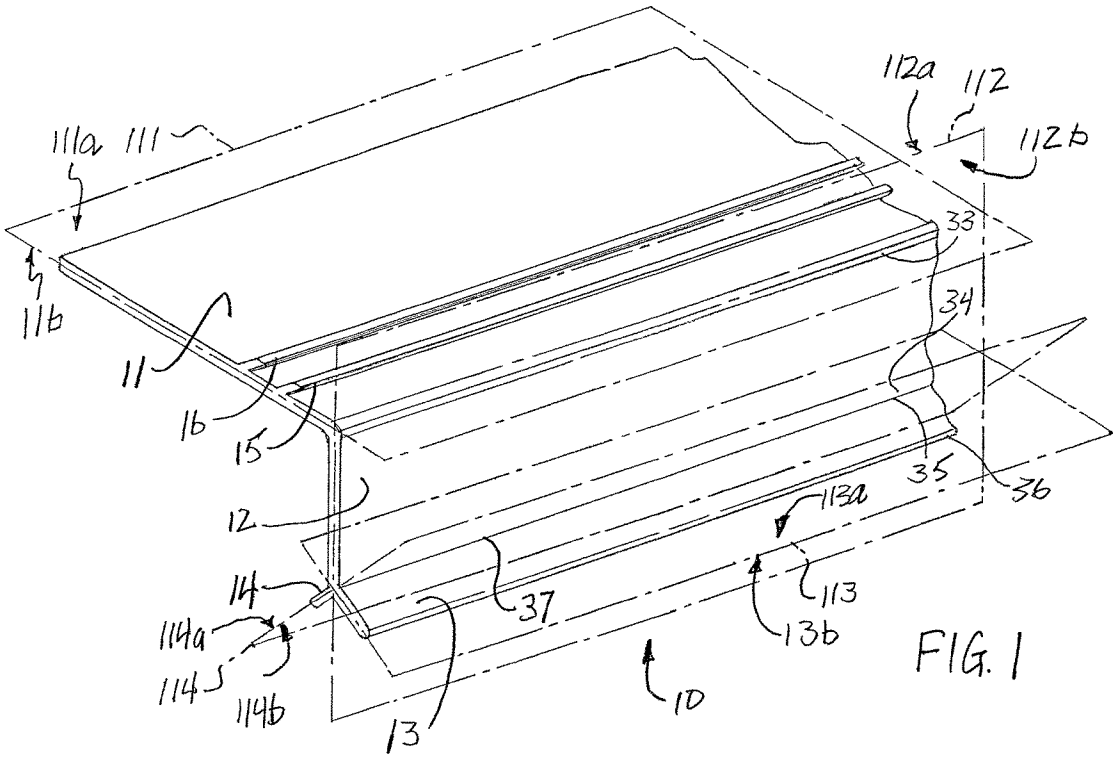
FIG. 1 is a perspective view of a first embodiment of the drip edge of the present invention.

FIG. 1 shows a roof drip edge 10 according to a first embodiment of the present invention. The drip edge 10 includes a roof leg 11, which is designed to interface with the roof of a building when the drip edge 10 is installed. A down leg 12 is joined to the roof leg, and is designed to extend downwardly from the edge of the roof in front of a fascia board or similar structure at the top of a wall of a building. A drip leg 13 is joined to the down leg 12 and extends at an angle away from the down leg. A back drip leg 14 is also joined to the down leg 12, but it extends from an opposite side of the down leg. As shown in the figures, each of the roof leg 11, down leg 12, drip leg 13, and back drip leg 14 are substantially planar.

The embodiment shown in FIG. 1 also includes a first tab 15 joined to the roof leg 11. The embodiment also includes a second tab 16 joined to the roof leg 11. The tabs 15 and 16 are also generally planar features, which, in this embodiment, extend in substantially parallel planes.

While the various portions of the drip edge 10 shown in the Figures are themselves substantially rectangular and planar, this is not necessarily the case in other embodiments. In other embodiments, the roof leg, down leg, drip leg, back drip leg, and tabs are not each necessarily planar, even though they extend substantially in an associated plane. For example, in some embodiments, the drip leg includes regular undulations along its length such that it is not strictly planar. Even so, such a drip leg extends substantially in a plane (herein referred to as a "drip leg plane") with respect to the other portions of the roof drip edge device. In other embodiments, the drip leg is substantially planar but is not rectangular. Such a drip leg includes a plurality of downwardly extending teeth, like a saw blade. Such a drip leg would still extend substantially in a drip leg plane.

The planes associated with the various parts of the drip edge are also shown in FIG. 1. Each of these planes has two sides as will be referenced in this disclosure. As shown in FIG. 1, the roof leg 11 has an associated roof leg plane 111, which has a first side 111*a* and a second side 111*b*. The down leg 12 has an associated down leg plane 112, which has a first side 112*a* and a second side 112*b*. The drip leg 13 has an associated drip leg plane 113, which has a first side 113*a* and a second side 113*b*. The back drip leg 14 has an associated back drip leg plane 114, which has a first side 114*a* and a second side 114*b*.

This disclosure also refers to certain edges of the various parts of the drip edge. As shown in FIG. 1, the roof leg 11 has a top edge 31 and a bottom edge 32. The down leg 12 has a top edge 33 (which, in this embodiment, is joined to the bottom edge 32 of the roof leg) and a bottom edge 34. The drip leg 13 also has a top edge 35 and a bottom edge 36. The back drip leg 14 has a top edge 37 and a bottom edge 38.

In the embodiment of FIG. 1, roof leg 11 extends substantially in the roof leg plane 111 and is joined to the down leg 12 such that the roof leg 11 extends away from the first side 112*a* of the down leg plane 112. The back drip leg 14 also extends away from the first side 112*a* of the down leg plane 112, while the drip leg 13 extends away from the second side 112*b* of the plane 112. The roof leg bottom edge 32 is joined to the down leg top edge 33. The drip leg 13 is joined to the down leg 12 at the bottom edge 34 of the down leg 12. In this embodiment, the back drip leg 14 is also joined to the down leg 12 at the bottom edge 34.

Figure 2:
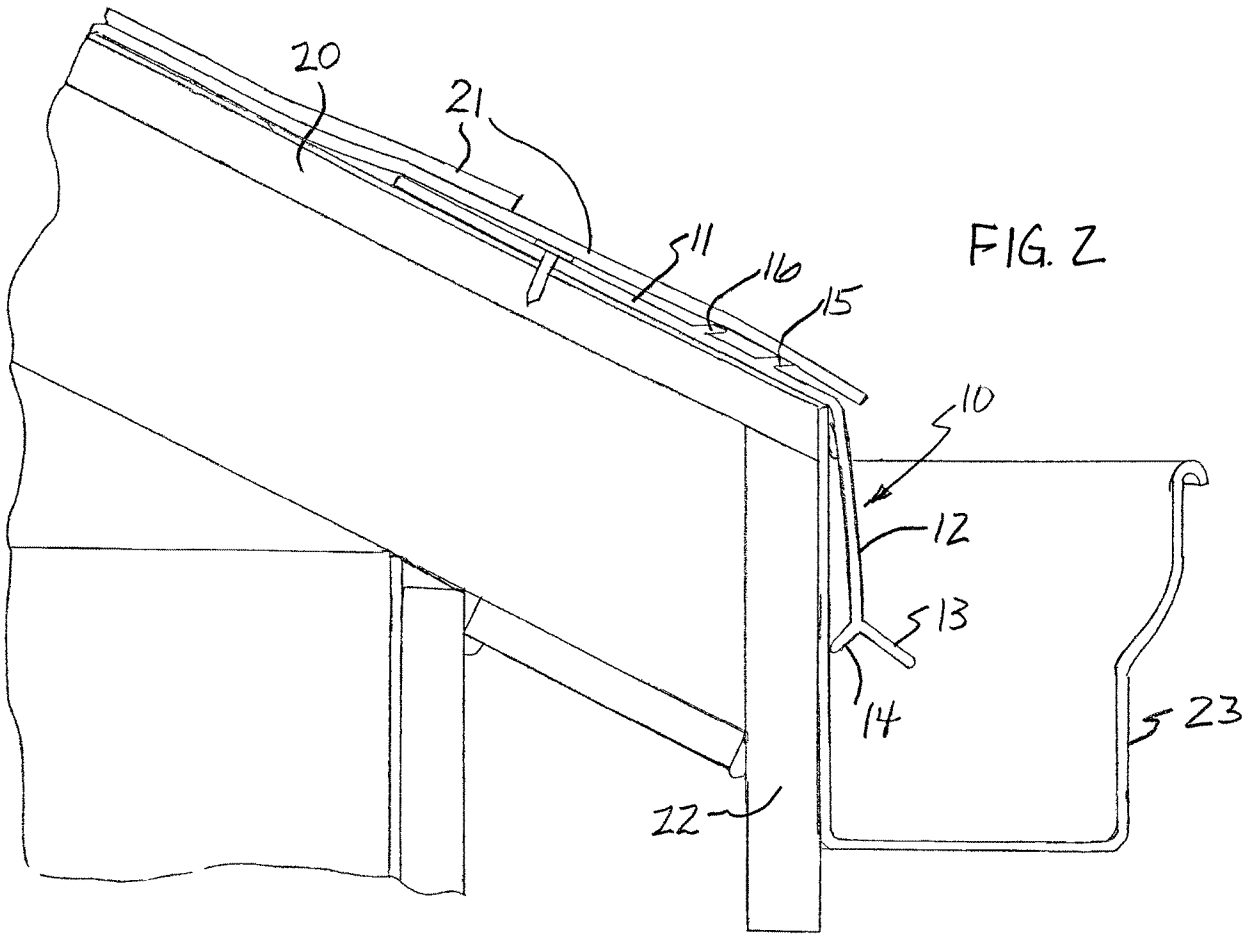
FIG. 2 is a side cross-section view of the drip edge shown in FIG. 1 that is installed at a roof/wall joint and shown with other building components installed.

FIG. 2 shows a side view of the drip edge 10 installed on a roof 20. The roof leg 11 is laid onto the roof 20 and, in some embodiments, nailed into place. Roof shingles 21 are then installed on the roof 20 such that the lower row or rows of shingles overlap the roof leg 11. The down leg 12 extends downwardly in front of the fascia board 22. The down leg 12 also interacts with a gutter 23, in some embodiments. The gutter 23 is mounted near the junction of the roof 20 and fascia board 22 and extends along the length of the edge of the roof to collect water. The down leg 12 extends at least partway into the gutter to ensure that such water does not contact the fascia board or somehow flow under the roof 20. In some embodiments, the drip edge includes openings sized for nails for attachment of the device to the building. In some embodiments, these openings are created in the roof leg and in other embodiments, the openings are created in both the roof leg and the down leg. In still other embodiments, the openings are created only in the down leg.

The drip leg 13 further ensures that water is kept away from the fascia board and roof. The drip leg 13 extends at an angle from the down leg 12 towards the outer edge of the gutter 23. This ensures that water that may not immediately separate from the drip edge 10 (due to surface tension, for example) is held away from and not in contact with the fascia board.

The embodiment shown in FIG. 1 also includes a back drip leg 14. The back drip leg 14 serves multiple advantageous functions with respect to the drip edge device 10. First, it provides an improved seal against water moving up behind the down leg 12. This issue can be a problem if, for example, the gutter drain becomes clogged and water collects in the gutter. The back drip leg 14 helps seal out that collected water from the fascia and roof components. Second, the back drip leg increases the pressure with which the down leg 12 contacts the surface behind it, thereby improving the quality of the seal mentioned previously. In the embodiment shown in FIG. 1, the drip edge 10 is formed of a flexible, plastic material such that the back drip leg creates a spring-like force between the down leg 12 and the gutter 23. As such, in the embodiment shown, the back drip leg is arranged with respect to the down leg such that the back drip leg makes substantially sealing contact with a roof fascia component. Roof fascia components include the fascia board itself, a portion of a gutter attached to a fascia board, or any other part or material secured to the outer face of the fascia board. In the embodiment shown in FIG. 2, the back drip leg 14 makes substantially sealing contact with a portion of the gutter 23. The back drip leg 14 is an advantageous feature of many embodiments of the present invention.

In the embodiment of FIGS. 1-4, the spring-like force with which the back drip leg 14 contacts the fascia board 22 is enhanced further by the orientation of the roof leg 11 with respect to the down leg 12. In this embodiment, the roof leg 11 and down leg 12 are joined at about a 90° angle. However, in most roof applications, such as that depicted in FIG. 2, the roof 20 is at an angle with respect to the fascia board 22 that is larger than 90°. When the drip edge 10 is applied to the roof 20, because the drip edge 10 is formed of a flexible, resilient material, the resiliency of the material will cause the down leg 12 to press against the fascia board while the roof leg 11 presses against the roof. In other embodiments, the angle at which the roof leg and the down leg are joined is different based on the desired application. In some embodiments, the angle is less than 90° so as to further increase the pressures applied by the roof leg and down leg described above, and in other embodiments, the angle is greater than 90° so as to provide an easier fit with the roof.

The embodiment of FIGS. 1-4 includes the feature that the back drip leg 14 and the drip leg 13 are joined at the same location on (or portion of) the down leg 12. In other embodiments, however, the back drip leg and drip leg are joined to the down leg at different locations on the down leg. In FIG. 5*a*, for example, the back drip leg 214 is located higher up on the down leg 212 than the drip leg 213. In FIG. 5*b*, the drip leg 413 is located higher on the down leg 412 than the back drip leg 414. In some installations of the embodiment shown in FIG. 5*b*, the back portion of the gutter 23 is secured between the back drip leg 414 and the drip leg 413. In such an installation, the back portion of the back drip leg 414 presses the back drip leg 414 directly against the fascia board, providing a seal. The relative locations of the back drip leg and the drip leg can be varied according to the desires of the user. In some embodiments, the back drip leg is located at approximately the mid-point of the down leg, and in other embodiments, the back drip leg is located at approximately one third of the total width of the down leg from the bottom of the down leg. Similarly, the drip leg is located at approximately the mid-point of the down leg in some embodiments and at approximately one third of the totally width of the down leg from the bottom edge of the down leg.

The tabs 15 and 16 are designed to be disposed under the roof shingles 21. In the embodiment shown, the tabs are flexible, so that they bend downward toward the surface of the roof leg 11 when the shingles are installed on top of the tabs. In some embodiments, the device 10 has only a single tab in or around the position of the tabs 15 and 16 shown in the Figures. The tabs 15 and 16 serve to prevent water from migrating up and under the shingles. This protects the roof 20 from water damage.

Figure 3:
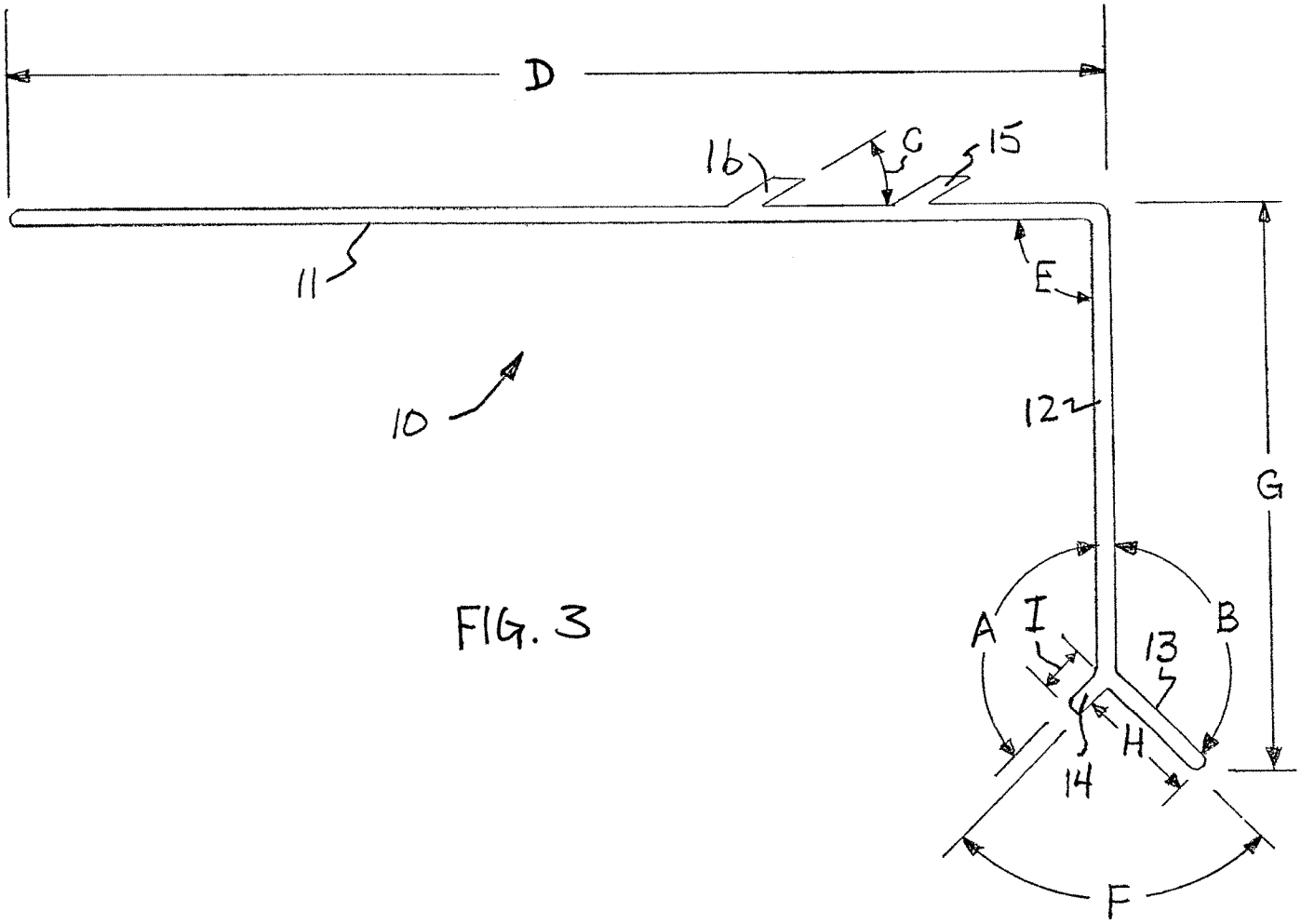
FIG. 3 is a side view of the drip edge shown in FIG. 1.

FIG. 3 shows side view of the drip edge 10, which highlights some key dimensional relationships according to the first embodiment. First, the roof leg 11 and the down leg 12 are joined at an angle E of about 90°. In the embodiment shown in FIG. 3, the joint between roof leg 11 and down leg 12 is a small-radius curve. This design makes installation easier as it permits easier molding to the particular roof drip edge shape and also permits easier joining with adjacent drip edges. In the embodiment shown, the radius of the curve is ⅛th of an inch. In other embodiments, however, the joint at angle E between the roof leg 11 and the down leg 12 is a sharp, right-angled corner.

The width D of the roof leg 11 is approximately twice the width G of the combination of the down leg 12 and drip leg 13. In the embodiment shown, the width D is about 5 inches, while the width G is about 2.5 inches. In some embodiments, the width D is about twice the width of the down leg by itself.

In some embodiments, the absolute sizes of the roof leg and the down leg, as well as their relative sizes, are important for certain applications. The larger sized roof leg provides enhanced protection of the roof underneath the shingles by making it less likely that water can move beyond the area protected by the drip edge to the unprotected roof material.

Both of the drip leg 13 and the back drip 14 are joined to the down leg 12 at angles A and B of about 135° in the embodiment shown. In other embodiments, the back drip 14 and the drip leg 13 are joined to the down leg 12 at other angles. In some embodiments, the back drip 14 is joined to the down leg 12 at an angle A that is greater than approximately 90 degrees. As used herein, the term "approximately" is about +/−10%. In other embodiments, the back drip 14 is joined to the down leg 12 at other angles, such as approximately 100 degrees, approximately 110 degrees, approximately 120 degrees, approximately 130 degrees, approximately 140 degrees, approximately 150 degrees, approximately 160 degrees, or approximately 170 degrees. Similarly, the drip leg 12 is joined to the down leg 12 in other embodiments at an angle greater than approximately 90 degrees. In other embodiments, the drip leg 12 is joined to the down leg at an angle such as approximately 100 degrees, approximately 110 degrees, approximately 120 degrees, approximately 130 degrees, approximately 140 degrees, approximately 150 degrees, approximately 160 degrees, or approximately 170 degrees.

The width H of the drip leg 13 is about 0.5 inches, while the width I of the back drip leg 14 is about 3/16ths of an inch. These sizes are varied in other embodiments. For example, as an alternative to the embodiment shown in FIG. 5*b*, the back drip leg 414 is wider than the drip leg 413. This same arrangement is found in other version of all of the embodiments shown and described.

The back drip leg 14 and drip leg 13 form about a 90° angle (shown as F in FIG. 3) with respect to one another. The angles A, B, and F are at joints that are formed as small-radius curves in the embodiment shown, as opposed to sharp corners as in other embodiments.

Regarding the tabs 15 and 16, each protrudes about ⅛ of an inch above the plane of the roof leg 11. Each also protrudes at an angle C of about 30° from the roof leg 11. Tab 15 is positioned about ⅝ths of an inch from the joint at which the roof leg 11 is joined to the down leg 12. Tab 6 is positioned about ¾ths of an inch from tab 15. In other embodiments, the tabs are positioned differently, but generally the tabs or tab are positioned in the half of the roof leg 11 nearest to down leg 12.

The embodiment shown in FIG. 3 has an approximate thickness of about 0.075 inches. This thickness is generally consistent throughout the various parts of the drip edge 10. The thickness is varied in some embodiments along with the material used in order to control the flexibility and resilience of the device.

Other embodiments have different important dimensional relationships. For example, in some embodiments, the angle that the tab or tabs makes with the roof leg plane is any angle between 0° and 90°.

Figure 6:
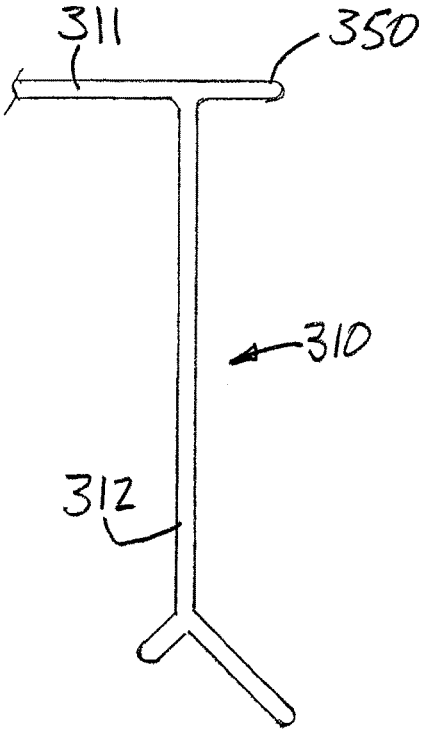
FIG. 6 is a side view of a third alternative embodiment of a drip edge of the present invention.

In the embodiment shown in FIGS. 1-4, the drip edge advantageously has a simple corner joint between the roof leg 11 and the down leg 12. This type of joint is advantageous because it is relatively strong while also simple to manufacture and handle during installation. In other embodiments, however, the corner joint has different configurations to meet different requirements of various applications. For example, as shown in FIG. 6, an alternative embodiment of a drip edge 310 has a corner extension 350 at the joint between the roof leg 311 and the down leg 312. The corner extension 350 is desirable in certain roof applications.

In the embodiment of the invention shown in the figures, the drip edge 10 is constructed of a polymer plastic material. The drip edge, including the roof leg and the down leg, the tabs, and the back drip leg and drip leg, is a single unitary piece. In an advantageous embodiment, the drip edge is extruded by a melt extrusion process. As is known in the art, such a process generally involves melting raw plastic pellets and forcing the melted plastic through a die. The extrusion product is then cooled so that it hardens into the shape created by the die. Drip edges made by this method can be made into virtually any desirable length. Other suitable manufacturing processes are employed in other embodiments, such as injection molding.

The material used in the most advantageous embodiments of the present invention is flexible and completely waterproof. The most advantageous polymers for this application do not degrade significantly with time. Such advantageous polymers include additives to increase the material's resistance to breakdown due to exposure to ultraviolet (UV) light.

In the embodiment shown in the figures, the extruder die used to extrude the drip edge is arranged such that the portion of the die that forms the roof leg is at an angle of approximately 90° with respect to the portion of the die that forms the down leg. Different extruder die designs and different material compositions will result in different final resting angles between the legs. Those of ordinary skill in the art can select the appropriate angle for their intended application of the drip edge as desired.

In the advantageous embodiment shown in the figures, the drip edge is constructed using a polypropylene-based composition in the thermoplastic elastomer olefinic chemical family. The composition includes polypropylene, a styrene ethylene butylene styrene copolymer, calcium carbonate, antioxidant/stabilizer, and mineral oil. A colorant is also added to provide the desired appearance of the drip edge and to enhance the UV breakdown resistance of the drip edge. Pigments and other fillers are generally encapsulated in the resin so as to avoid any hazardous conditions when the material is processed.

The embodiment of the drip edge shown in the figures is made using a material that will not show evidence of visible cracks after exposure to ozone pressure of 100 mPa and a temperature of 104° F. for 70 hours, pursuant to ASTM Standard D1149-12. Further, the material used in the embodiment of the figures will not show appreciable change in mass or volume after submersion in distilled water at a temperature of 158° F.±2° F. for a minimum of 46 hours, pursuant to ASTM Standard D471-06. Specifically, the material will have a percent change in mass and volume of about 0.00%, respectively.

The material used in the embodiment of the figures also meets the AC286 Section 4.4 standard using the ASTM Standard D412-06 tensile strength and elongation procedure even after weathering for 2000 hours in accordance with ASTM G154. Specifically, the average ultimate elongation of the weathered material exceeds the minimum of 210 percent under SC286 Section 4.4 and the minimum of 85 percent under AC286 Section 4.7 with respect to control specimens. Even more specifically, the material has an average tensile strength of 1530 psi before weathering and an average tensile strength of 1490 psi post-weathering. The material has an average elongation percent of 472% before weathering and 427% post weathering.

The tear strength of the material used in the embodiment of the figures exceeds the minimum of 1.43 pounds per inch pursuant to AC286 Section 4.5 and ASTM Standard D624-12. Specifically, the material has an average tear strength of 733 pounds per inch.

The material used in the embodiment of the figures does not show signs of cracking or brittleness when tested at −40° C. in accordance with AC286 Section 4.6 and ASTM Standard D2137-11. Furthermore, the material meets the tensile strength and elongation requirements of AC286 Section 4.7 even after exposure to Ultra Violet radiation pursuant to ASTM Standard G154-06. In other words, its average ultimate elongation percent exceeds 85% of the average elongation percent of the control specimens.

Advantageously, the material of the embodiment of the drip edge shown in the figures is selected to expand and contract in concert with the expansion and contraction of the other building materials around the drip edge, such as the roof, wall, shingles, siding, etc. This minimizes the effects of such expansion and contraction on the seals between sections of drip edge and the overall strength of the drip edge.

A further advantage of embodiments of the present invention that are formed of the above-described polypropylene-based composition is that the drip edge does not conduct electricity like traditional, metal drip edges. Traditional metal drip edges can attract lightning due to their conductivity. Embodiments of the present invention that are formed of certain polymer plastic materials, such as the above-described polypropylene-based composition, have negligible conductivity. The result is that roofs that use such embodiments of the present invention instead of metal drip edges are far more resistant to lightning strikes or other electrical damage.

Figure 4:
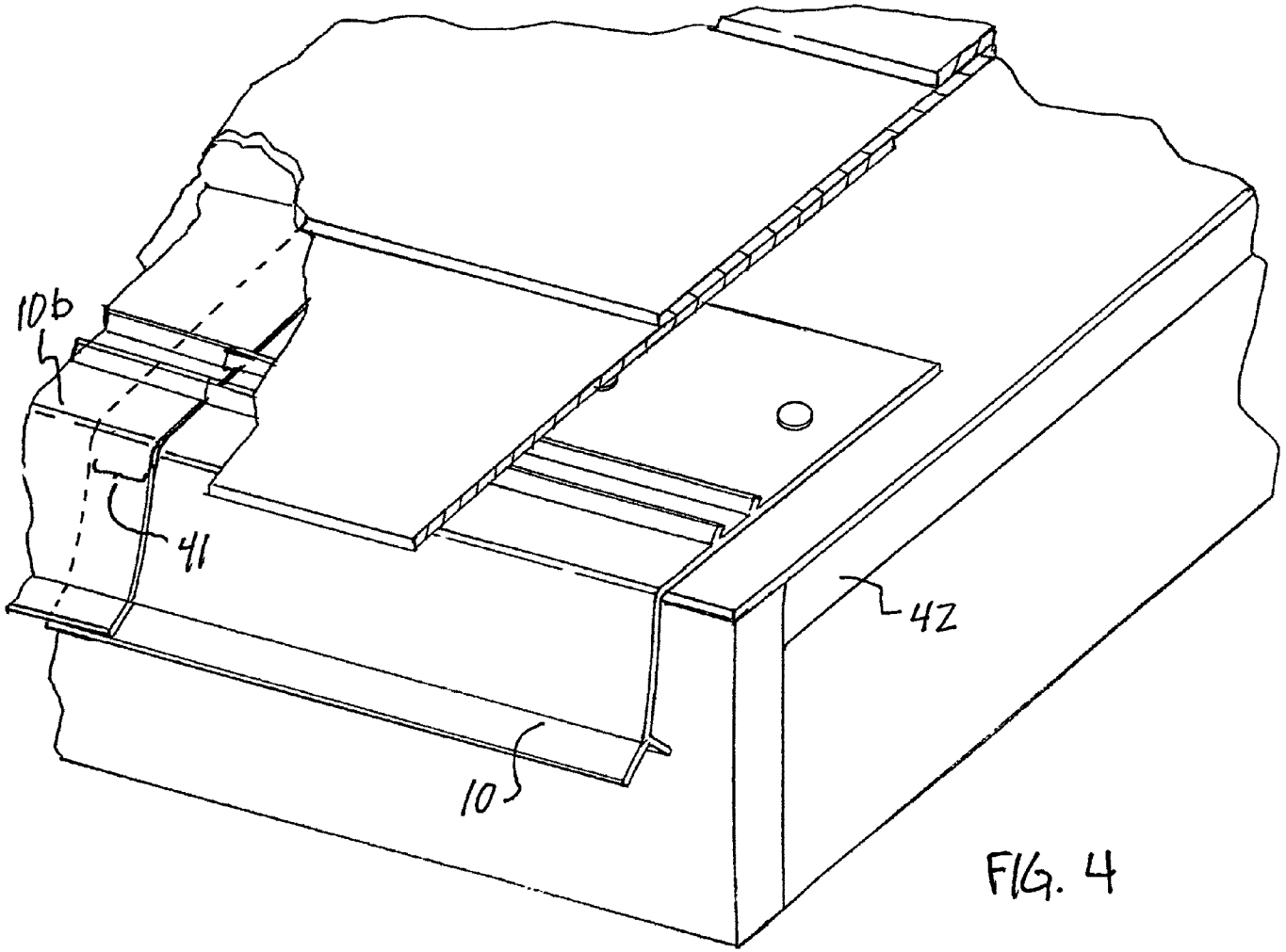
FIG. 4 is a perspective cut-away view of the drip edge shown in FIG. 1 that is installed at a roof/wall joint and shown with other building components installed.
Figure 5A:
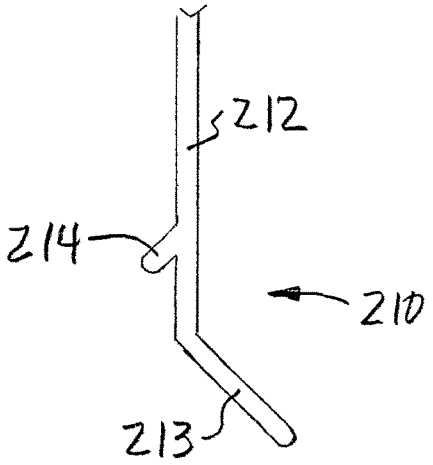
FIG. 5*a* is a side view of an alternative embodiment of a drip edge of the present invention.
Figure 5B:
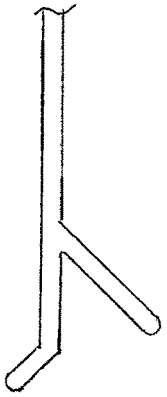
FIG. 5*b* is a side view of a second alternative embodiment of a drip edge of the present invention.

FIG. 4 demonstrates an advantage of this embodiment of present invention—a single piece of drip edge can be used along an entire length of the roof/wall joint even as the length exceeds multiple feet. As a result of its construction using a polymer and the extrusion technique, the drip edge can be made in a much greater length than traditional drip edges. As such, the drip edge of this embodiment of the present invention requires far fewer joints between pieces of drip edge. When a joint is required, the two pieces of drip edge can be joined by the technique of heat welding using a piece of polymer of the same or similar composition. This heat-welded joint remains strong and watertight much longer than a caulked joint between metal drip edges. The heat-welded joints require less maintenance and have a much lower risk of failure than traditional caulked joints. As those of skill in the art will appreciate, caulking is an inexact science. Once caulk loses its adhesion to a surface, it can act as siphon and draw water in. FIG. 4 also shows, schematically, a heat welded joint 41 between the drip edge 10 and a second drip edge 10*b* of the same design. The drip edges overlap and, between the two is a heat weld. For some installations, some portions of the protrusions on the drip edge 10 (such as tabs 15 and 16) are trimmed by the installer to permit two pieces of the drip edge to overlap and be welded together. In other embodiments, two sections of overlapping drip edges can be joined in a permanent, bonded relationship using an approved sealant. Such a sealant may fuse the two sections together permanently as if they had become a single, continuous section.

Drip edges according to embodiments of the present invention can also be advantageously applied to other parts of a roof. For example, embodiments of the present invention can be applied to the rake edge 42 shown in FIG. 4. The rake edge of a roof is the edge that runs from the roof drip edge to the roofs peak. The drip edge devices according to the present invention help protect roof components along the rake edge just as they do along the roof drip edge—the devices seal out water and protect the roof from wind, sun, and other potentially detrimental elements.

The flexibility of the drip edge according to the exemplary embodiments shown in the figures also improves the ease and quality of the installation. The flexible drip edge is better able to adapt to variations in the wall, fascia board, roof, or joint between the two. This improves the waterproofing function of the drip edge.

It will also be understood that patching or repairing the drip edge of the present invention is much easier and less expensive than with drip edges of the prior art. Should a crack or hole form in the drip edge of the present invention, it is relatively straight forward to apply a heat weld patch directly to the affected area. Such a repair will provide a consistent surface and will be long-lasting.

While this invention has been described in specific terms related to an exemplary embodiment or embodiments, it will be understood by those of skill in the art that modifications may be made in the configurations and dimensions of those embodiment(s) without departing from the following claims.

What is claimed is:

1. A roof drip edge device, comprising:

a down leg, extending substantially in a down leg plane and comprising a first side and a second side;

a roof leg, extending substantially in a roof leg plane and joined to the down leg such that the roof leg extends away from the first side of the down leg;

a drip leg, extending substantially in a drip leg plane and joined to the down leg such that the drip leg extends away from the second side of the down leg; and a back drip leg, extending substantially in a back drip leg plane and joined to the down leg such that the back drip leg extends away from the first side of the down leg plane;

wherein the back drip leg is joined to the down leg such that the back drip leg plane and the down leg plane are at an angle of greater than approximately 90 degrees with respect to one another.

2. The device of claim 1, wherein the back drip leg is joined to the down leg at substantially the same portion of the down leg as the drip leg.

3. The device of claim 1, wherein the down leg further comprises a top edge and a bottom edge and wherein the roof leg further comprises a top edge and a bottom edge, and wherein the roof leg bottom edge is joined to the down leg top edge.

4. The device of claim 3, wherein the distance between the roof leg top edge and the roof leg bottom edge is at least approximately twice the distance between the down leg top edge and the down leg bottom edge.

5. The device of claim 1, wherein the down leg further comprises a top edge and a bottom edge and wherein the drip leg is joined to the down leg at the down leg bottom edge.

6. The device of claim 5, wherein the back drip leg is joined to the down leg at the down leg bottom edge.

7. The device of claim 1, wherein the roof leg is joined to the down leg such that the down leg plane and the roof leg plane are at approximately a 90 degree angle with respect to one another.

8. The device of claim 5, wherein the drip leg and the back drip leg are joined to the down leg bottom edge such that the drip leg plane and the back drip leg plane are at approximately a 90 degree angle with respect to one another.

9. The device of claim 1, wherein the drip leg is joined to the down leg such that the drip leg plane and the down leg plane are at approximately a 135 degree angle with respect to one another.

10. The device of claim 1, wherein the back drip leg is joined to the down leg such that the back drip leg plane and the down leg plane are at approximately a 135 degree angle with respect to one another.

11. The device of claim 1, further comprising:

a first tab, extending from a first side of the roof leg and substantially in a first tab plane, wherein the first tab plane forms an angle with the roof leg plane that is less than 90 degrees and greater than 0 degrees.

12. The device of claim 11, further comprising a second tab, extending from the first side of the roof leg and substantially in a second tab plane, wherein the second tab plane is substantially parallel to the first tab plane.

13. The device of claim 1, wherein the device is comprised of a flexible, plastic material.

14. The device of claim 13, wherein the device is formed by an extrusion process.

15. A roof drip edge device, comprising:

a down leg, extending substantially in a down leg plane and comprising a first side, a second side, a top edge, and a bottom edge;

a roof leg, extending substantially in a roof leg plane and comprising a top edge and a bottom edge, wherein the roof leg bottom edge is joined to the down leg top edge such that the roof leg extends away from the first side of the down leg;

a drip leg, extending substantially in a drip leg plane and joined to the down leg such that the drip leg extends away from the second side of the down leg;

a back drip leg, extending substantially in a back drip leg plane and joined to the down leg such that the back drip leg extends away from the first side of the down leg plane; and a tab, extending from a first side of the roof leg and substantially in a tab plane, wherein the tab plane forms an angle with the roof leg plane that is less than 90 degrees and greater than 0 degrees;

wherein the back drip leg is arranged with respect to the down leg such that the back drip leg will make substantially sealing contact with a roof fascia component.

16. The device of claim 15, wherein the back drip leg is joined to the down leg such that the back drip leg plane and the down leg plane are at an angle of greater than approximately 90 degrees with respect to one another.

17. The device of claim 15, wherein the tab is a first tab and the tab plane is a first tab plane, and wherein the device further comprises a second tab, extending from the first side of the roof leg and substantially in a second tab plane, wherein the second tab plane is substantially parallel to the first tab plane.

18. The device of claim 15, wherein the roof leg is joined to the down leg such that the down leg plane and the roof leg plane are at approximately a 90 degree angle with respect to one another.

19. A roof drip edge device, comprising:

a down leg, extending substantially in a down leg plane and comprising a first side and a second side;

a roof leg, extending substantially in a roof leg plane and joined to the down leg such that the roof leg extends away from the first side of the down leg;

a drip leg, extending substantially in a drip leg plane and joined to the down leg such that the drip leg extends away from the second side of the down leg;

a back drip leg, extending substantially in a back drip leg plane and joined to the down leg such that the back drip leg extends away from the first side of the down leg plane;

a first tab, extending from a first side of the roof leg and substantially in a first tab plane, and a second tab, extending from the first side of the roof leg and substantially in a second tab plane;

wherein the first tab plane forms an angle with the roof leg plane that is less than 90 degrees and greater than 0 degrees; and wherein the back drip leg is joined to the down leg such that the back drip leg plane and the down leg plane are at an angle of greater than approximately 90 degrees with respect to one another.

20. The device of claim 19, wherein the down leg further comprises a top edge and a bottom edge and wherein the roof leg further comprises a top edge and a bottom edge, and wherein the roof leg bottom edge is joined to the down leg top edge; and wherein the device is comprised of a flexible, plastic material.

* * * * *